United States Patent [19]

Fuss

[11] 4,079,858

[45] Mar. 21, 1978

[54] DISPENSING MEANS AND METHOD WITH ADJUSTABLE RELEASE MEANS

[75] Inventor: Gunter G. Fuss, San Carlos, Calif.

[73] Assignee: Safe-T Pacific Company, Redwood City, Calif.

[21] Appl. No.: 736,322

[22] Filed: Oct. 28, 1976

[51] Int. Cl.[2] ..... B65G 59/10

[52] U.S. Cl. ..... 221/1; 221/304; 221/308

[58] Field of Search ..... 221/304, 303, 307–310, 221/44, 241, 1

[56] References Cited

U.S. PATENT DOCUMENTS

| | | | |
|---|---|---|---|
| 1,256,913 | 2/1918 | Luellen | 221/310 X |
| 2,606,087 | 8/1952 | Tansley | 221/307 X |
| 2,780,388 | 2/1957 | Stephenson | 221/44 |
| 3,435,987 | 4/1969 | Saunders et al. | 221/307 |
| 3,462,044 | 8/1969 | McKenna | 221/308 |

*Primary Examiner*—Robert B. Reeves

*Assistant Examiner*—Francis J. Bartuska

*Attorney, Agent, or Firm*—Flehr, Hohbach, Test, Albritton & Herbert

[57] ABSTRACT

A nested cone holder and dispenser making use of an adjustable cone release mechanism for safely dispensing different selected sizes of fragile products such as ice cream cones, cups and the like. The device employs an elongate flexible container for holding cones, cups and the like nested items to be dispensed, together with the cooperating adjustable release mechanism which dispenses individual nested items from the bottom without crushing the edges of the same. The release mechanism includes pads of brush-like material carried at the lower end or edge margin of the container and positioned adjacent the discharge opening. The pads are mounted on rigid U-shaped clips which are readily removable and which can be disposed variously around the lower edge margin to vary the effective size of the dispensing opening.

8 Claims, 11 Drawing Figures

DISPENSING MEANS AND METHOD WITH ADJUSTABLE RELEASE MEANS

BACKGROUND OF THE INVENTION

This invention relates generally to dispensing means of a kind adapted to store and dispense a succession of individual nested articles such as fragile ice cream cones and cups, heat insulating cups, or the like, and to a method for altering the effective size of a discharge opening through which the articles are dispensed. This invention is more particularly directed to an arrangement in which the cone release mechanism or means for retaining the cones or cups within the container provides an adjustable effective opening whereby selected sizes can be gently dispensed through the release mechanism, and to a method of selectively varying the size of the discharge opening.

A problem has been presented in providing a unitary readily adjustable release mechanism for gently dispensing articles of the type described, in varying sizes, and in such manner as to avoid damage to the dispensed items.

OBJECTS AND SUMMARY OF THE INVENTION

In general the cone release means of the present invention serves to vary the effective size of the discharge opening of a container for dispensing articles of the kind described, by employing a U-shaped clip formed with opposed substantially rigid flat panels adapted to be disposed in flanking relation onto an arcuate flexible wall portion of the lower end or edge margin of the container wall adjacent the discharge opening. The clip is sufficiently rigid and adapted to embrace a sufficient extent of the edge margin to cause the clip to straighten that wall portion to which it is attached, and thereby reduce the effective size of the discharge opening by deforming the opening. Article retaining means are carried by at least the inner panel of the clip, and disposed to protrude into the opening for releasably retaining the articles to be dispensed.

The release means may further comprise a plurality of such clips disposed at the discharge opening of the container to provide a means for adjusting the effective size of the discharge opening. More specifically, the clips are positionable around the periphery of the opening to vary the spacing between the clips to thereby alter the minimum effective opening for passage of the fragile cones, cups and like articles therethrough, and in this way to accommodate varying selected sizes of articles to be dispensed.

In general it is an object of the present invention to provide an improved release means and method for dispensing nested bakery or other fragile articles.

It is a further object of the present invention to provide an adjustable cone release means for dispensing ice cream cones, cups and the like, together with a method for selectively varying the effective size of the dispensing opening for such products.

It is another object of the present invention to provide an improved release means of a type employing bristles.

The foregoing and other objects and advantages of the invention will be apparent from the following description, when considered in conjunction with the drawings.

DETAILED DESCRIPTION OF PREFERRED EMBODIMENTS

Figure 1:
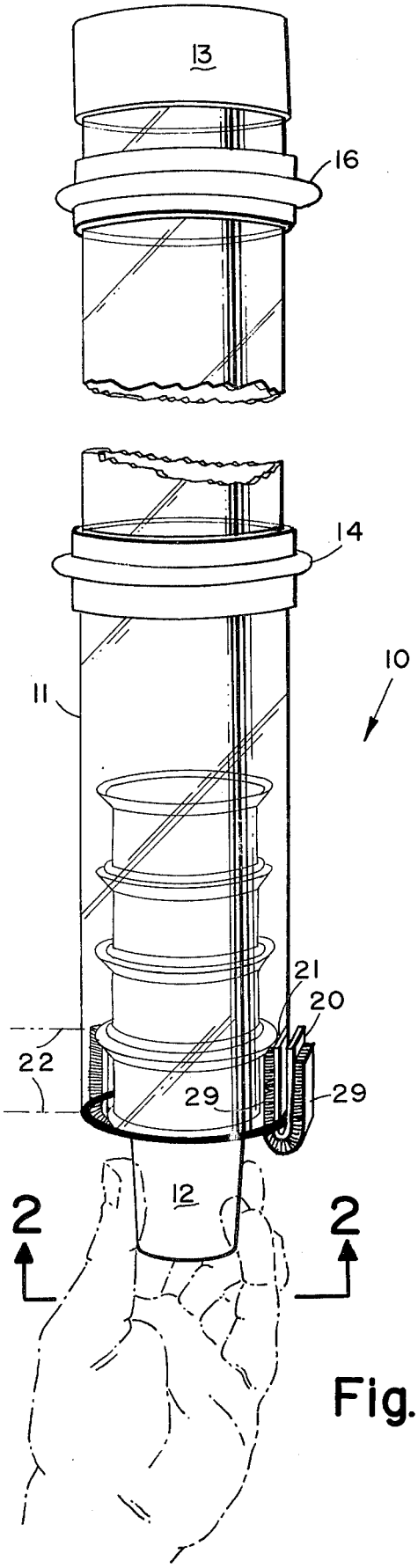
FIG. 1 shows an article holder and dispenser according to the invention.
Figure 2:
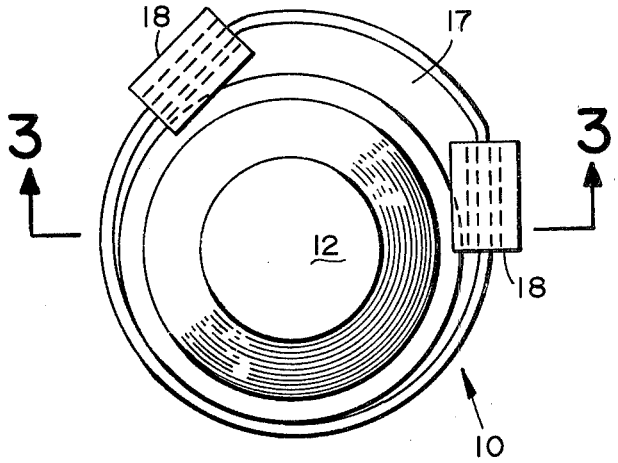
FIG. 2 is an enlarged bottom plan view of FIG. 1.
Figure 3:
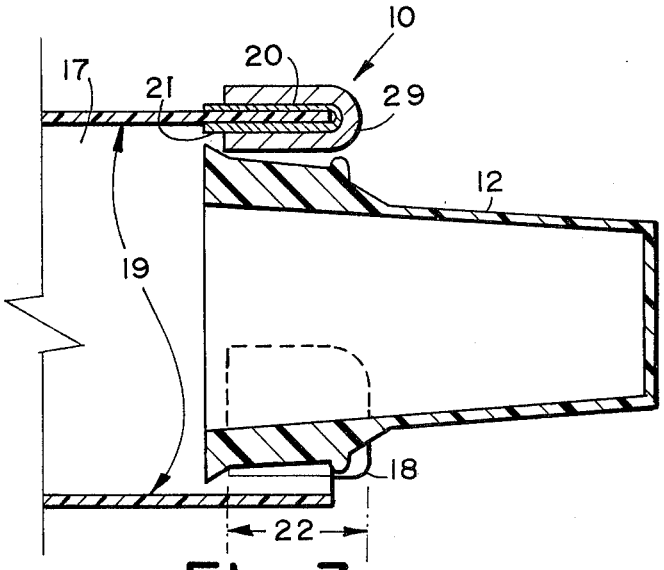
FIG. 3 is a view in section view along the line 3—3 of FIG. 2, and oriented 90°.
Figure 4:
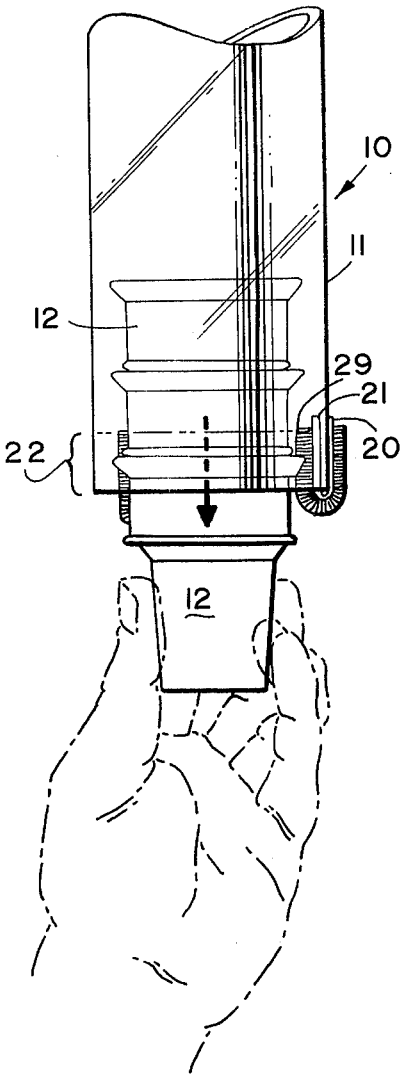
FIGS. 4 and 5 show sequential steps in withdrawing an article from the holder.
Figure 5:
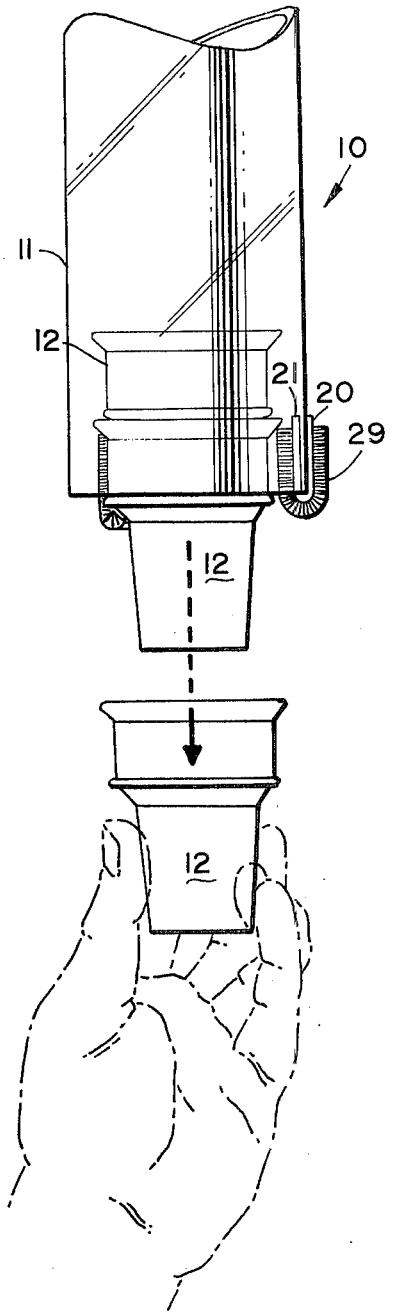

Referring to the embodiment of FIGS. 1–8, an article holder and dispenser assembly 10 comprises an elongate hollow cylindrical tube or container 11 for storing nested articles 12 therein of a type such as fragile baked ice cream cones or cups, or fragile drinking cups such as foam insulated cups, or the like. Container 11 is formed of a flexible plastic material such as the transparent plastic shown in FIG. 1, and carries a top closure 13 or cap thereon to prevent entry of any foreign objects or contamination.

Means for supporting the assembly 10 includes the longitudinally spaced supporting rings 14, 16 disposed in spaced relation along the length of container 11. Each of rings 14, 16 includes a flange formed with a planar surface on one side and a rounded surface on the other. In the case of ring 14, the planar surface faces downwardly and is adapted to rest upon an encircling supporting surface extending substantially around container 11. In the case of flange 16 the planar surface thereof is directed upwardly and disposed immediately beneath a similarly disposed surface having an opening therein extending around a substantial portion of container 11. Accordingly, rings 14, 16 serve to keep container 11 in a fixed vertical position so that it will neither move upwardly nor downwardly as mounted.

The lower end of container 11 defines a discharge opening 17 therein for dispensing articles 12.

Adjustable release means for varying the effective size of opening 17 includes a U-shaped clip 18 formed with opposed substantially flat panels 20, 21 adapted to be disposed in flanking relation to a portion 24 of the lower end or edge margin 22 of a wall of container 11 adjacent opening 17.

The clip 18 is formed of a material (e.g. aluminum) which is sufficiently rigid and of sufficient length to embrace the edge margin along a sufficient extent thereof to cause the clip to straighten that wall portion 24 so as to distort the circular cross-section of opening 17, thereby reducing the effective diameter of the opening. Thus clip 18 serves to flatten that portion of the wall which it clamps so as to reduce the effective diameter of an otherwise circular opening 17.

Figure 10:
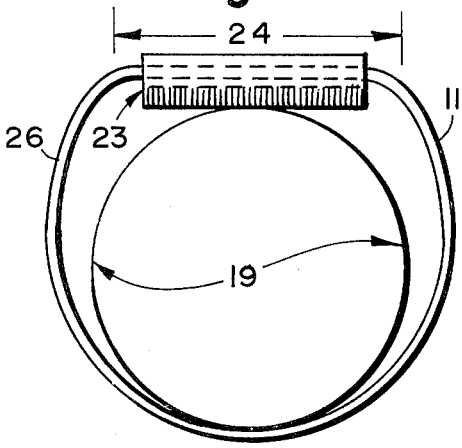
Figure 11:
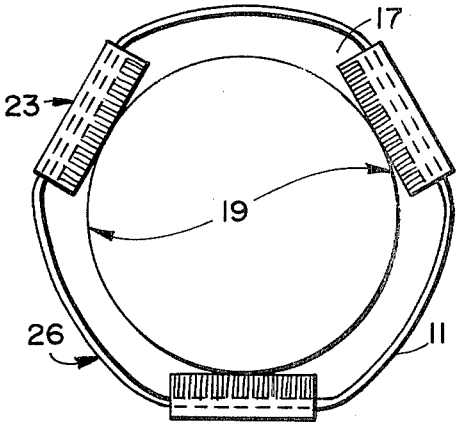

Accordingly, the foregoing release means takes advantage of the fact that any reduction or distortion of the circular cross section of a cylindrical configuration serves to reduce the effective size of the flow passage defined by such circular cross section. Therefore, it has been observed that by use of an elongate clip such as clip 23, the cylindrical configuration of passage 17 can be distorted to reduce the effective size of the opening for passing articles 12 therethrough (see FIGS. 10 and 11). Thus FIG. 10 shows the use of a single elongated clip 23, whereas FIG. 11 represents the use of additional elongate clips 23 for flattening separate portions of the opening 17 (in an otherwise cylindrical flexible tube 26) so as to further reduce the effective size of the opening (represented at 19).

Means for retaining articles 12 within container 11 are carried by each of the clips 18 or 23, to invade or protrude into the discharge opening 17 in a manner releasably retaining or supporting the articles which are being dispensed.

The retaining means comprises a bristle-like pad or material 29 applied to that panel 21 confronting opening 17. Thus, the retaining means is carried by at least the inner panel 21 of the clip so as to protrude into opening 17 for releasably engaging and supporting the articles to be dispensed.

In the embodiment of FIGS. 1–8 (see, particularly FIGS. 1, 4 and 5) clips 18 are shown with a bristle pad 29 formed on both panels of the clip so as to insure against erroneous positioning of the clip onto the lower edge margin 22, and for economy in manufacturing.

As noted, a plurality of clips 18 or 23 can be used in combination to establish a selected minimum effective opening 17 so as to accommodate discharge of varying selected sizes of the articles 12. Thus, as particularly shown in FIGS. 3, 6–8, and 11, the effective dimension of the dispensing opening is represented by the cross section of the circle 19.

Figure 9:
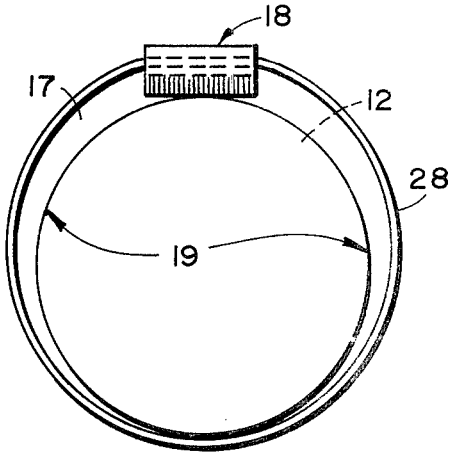
FIGS. 9, 10 and 11 are similar diagramatic representations according to other embodiments of the invention.

In the particular embodiment of FIG. 9, a maximum effective dispensing opening is obtained by use of a single clip 18. By examination of FIG. 9, it is readily evident that the retaining means in the form of clip 18 is disposed in position for urging the articles 12 to be dispensed into engagement with the cylindrical container wall, represented by the circle 28. It is also readily apparent that the effective dimension of the dispensing opening, represented at 19, is substantially equivalent to the diameter of the dispensed item 12, with allowance of course for the gentle inward protuberance of the flexible material of the bristle pad 29.

Figure 6:
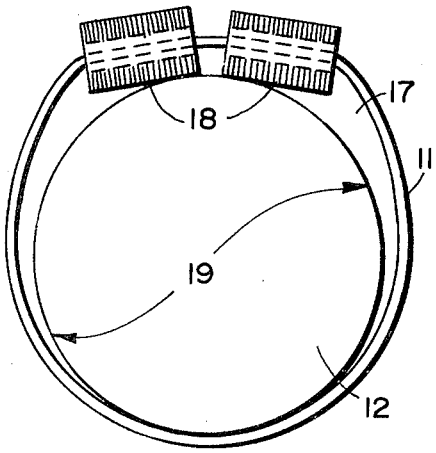
FIGS. 6, 7 and 8 are diagramatic representations similar to FIG. 2, illustrating varying uses of the invention, without the articles present.
Figure 7:
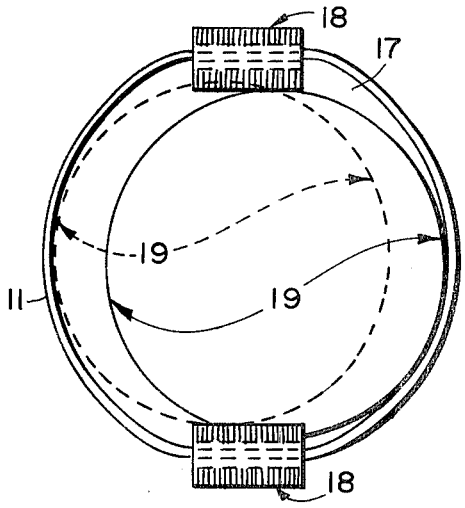
Figure 8:
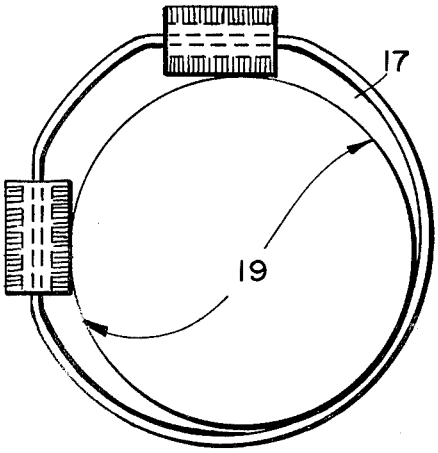

By introducing a second clip corresponding in structure to that of clip 18, as in the embodiment of FIGS. 1–8, a reduction in the size of the dispensing opening is achieved. In the particular arrangement of FIG. 7, wherein the second clip 18 is disposed in diametrically opposite position, a minimum effective opening 19 is created for the passage of articles therethrough, again as represented by the configuration of circle 19. With two retaining clips 18, as in the embodiment of FIGS. 1–8, a maximum effective opening is achieved by positioning the clips 18 adjacent each other, as shown in FIG. 6. It is evident that the two clips 18 are positioned as close together as possible so as to approximate the effective discharge opening achievable by use of a single clip 18, as in FIG. 7. Accordingly, in the case of two clips 18, the effective size of the discharge opening 17 is varied between the two extremes, represented by FIGS. 6 and 7, by positioning the clips around the wall of container 11 so as to vary the angular spacing therebetween. In this way the minimum effective opening (FIG. 7) may be enlarged to accommodate the diameter of selected sizes of articles. For example, an intermediate reduction in the effective size of discharge opening 17 can be achieved, as shown in FIG. 8, by disposing the clips at a position intermediate those positions established in FIGS. 6 and 7.

In the embodiment of FIG. 10, a single elongated clip 18 is employed, the length being sufficient to facilitate flattening of a substantial arcuate position of the flexible container wall 11, to thereby greatly reduce the diameter of the dispensing opening 17. In this embodiment, it is evident that the material of the tubular container 11 is sufficiently flexible to permit ready engagement on the edge margin, of a rigid clip of the illustrated length, to thereby flatten it in the manner depicted in FIG. 10.

The positioning of rigid clips of the type described on the lower edge margin of the container 11 is easily accomplished. Thus it is only necessary to grip the lower end of container 11 on opposite sides and thereafter squeeze the bottom opening 17 into an oval configuration, thus reducing or flattening the arcuate curvature of the side wall. In this position of the container wall, the clips can be readily disposed in clamping relation to the end edge margin 22.

With reference to the foregoing description of the apparatus, it is apparent that a method has also been disclosed for selectively altering the effective size of a generally cylindrical dispensing opening, in an elongate hollow container of the type described. The method includes the steps of positioning a first rigid clamp means onto a lower edge margin of the flexible container in a manner to protrude into the opening. Thereafter a second rigid clamping means is positioned at a spaced peripheral position of the lower edge margin in a manner also to protrude into the opening. The third step in the method involves adjusting the angle defined between the two rigid clamp means, as measured from the axis of the container, to establish the effective size of the dispensing opening.

In addition the additional steps of removing one of the rigid clamp members and thereafter positioning it at a different angular position, can be employed in order to further vary the effective opening of the container. In each instance, the projected angle at the axis of the container serves to determine the effective size of the dispensing opening.

From the foregoing it is readily evident that there has been provided an improved article holder and dispenser having a particularly improved release means whereby the effective size of the discharge opening can be varied as desired. For example, the lower end opening 17 of container 11 can, in its simplest construction, employ a single clip 18 attached to the lower end edge margin 22. The effective size of the end opening can be reduced by means of one or more of the clips 18. For example, by employing a single elongate slip, such as the clip 23 shown in FIG. 10, the circular configuration of container 11 is readily deformed to diminish the effective size of the opening to a greater extent. On the other hand if a plurality of such clips are employed they need not necessarily be the elongate clips 23, but can be the shorter variety 18 as shown in FIGS. 1 through 9, with the angular positioning of the clips serving to establish the effective size of the opening. In each case, the bristle pads 29 serve to gently support the stack of nested fragile items, and to effectively permit dispensing of such items one by one without forceful or abrasive impacts such as would crush or damage fragile peripheral edges on the dispensed items. Accordingly, it should be understood that the disclosures and description of particular embodiments herein are intended as purely illustrative, and not in any sense limiting.

What is claimed is:

1. In an article holder and dispenser for storing and dispensing nested articles such as ice creams cones, cups and the like, an elongate hollow container, said hollow container having an annular body portion defining a discharge opening at one end thereof for passage of said articles, adjustable release means including a plurality of retainer elements disposed at said discharge opening and serving to protrude into the discharge opening for releasably retaining the articles to be dispensed, said retainer elements being positionable around said periphery to vary the spacing therebetween for changing the minimum effective opening to facilitate discharge and dispensing of selected sizes of said article, at least one of said retainer comprising a U-shaped rigid clip formed to releasably embrace and flatten a lower edge portion of said container to reduce the size of said discharge opening, and means carried by said clip protruding into said opening for releasably engaging the articles passing therethrough.

2. An article holder and dispenser for nested articles such as ice cream cones, cups, and the like comprising an elongate hollow container for storing the articles therein, said container having an annular body portion defining an opening at one end thereof for dispensing the articles therethrough, retainer means carried by and substantially at the periphery of said discharge opening and serving to protrude into the discharge opening for releasably retaining the articles to be dispensed, said retaining means including a U-shaped rigid clip formed to releasably embrace and flatten a portion of the lower edge of said container to thereby reduce the effective size of said discharge opening, and means carried by said clip protruding into said opening for releasably engaging the articles passing therethrough.

3. An article holder and dispenser for nested articles such as ice cream cones, cups and the like, comprising an elongate hollow container for storing the articles therein, said container having an annular body portion defining an opening at one end thereof for dispensing the articles therethrough, retainer means carried by and substantially at the periphery of said discharge opening and serving to protrude into the discharge opening for releasably retaining the articles to be dispensed, said retaining means including a plurality of U-shaped rigid clips formed to releasably embrace and flatten portions of the lower edge of said container to thereby reduce the effective size of said discharge opening, and means carried by said clip protruding into said opening for releasably engaging the articles passing therethrough.

4. In a dispensing device, means for adjusting the effective size of a dispensing opening at a lower end of an elongate hollow container of flexible annular cross-section, such container being of a type for dispensing a succession of stored articles therethrough, said means comprising a U-shaped clip formed with opposed substantially flat panels adapted to be disposed in flanking relation to an arcuate portion of a lower edge margin of said flexible hollow container adjacent said dispensing opening, the material of said clip being sufficiently rigid to straighten said portion to reduce the effective diameter of said opening, and retainer means carried by at least the inner panel of said clip and adapted to protrude into the opening for releasably retaining the articles to be dispensed.

5. Clip means as in claim 4 in which said retainer means comprises a bristle-like material applied to that panel of said clip confronting the opening.

6. Release means for varying the effective size of the discharge opening of a container for dispensing nested articles such as ice cream cones, cups and the like, comprising: a U-shaped clip formed with opposed substantially rigid flat panels adapted to be disposed in flanking relation onto an arcuate flexible portion of an edge margin of a lower end of said container adjacent said discharge opening, said clip being sufficiently rigid and of a length to embrace said edge margin along a sufficient extent thereof to cause the clip to straighten said flexible portion to reduce the effective diameter of said discharge opening, and retainer means carried by at least the inner panel of said clip and adapted to protrude into the opening for releasably retaining the articles to be dispensed.

7. In a method for selectively altering the effective size of a generally cylindrical dispensing opening formed at the bottom of an elongate hollow flexible container, the steps of positioning a first rigid substantially U-shaped clamp means onto a lower edge margin of said flexible container in a manner to straighten a portion of said cylindrical dispensing opening so as to reduce the effective diameter thereof, and thereafter positioning a second rigid substantially U-shaped means at a spaced peripheral position of said lower edge margin in a manner to straighten a portion of said cylindrical dispensing opening so as to further reduce the effective diameter thereof, and adjusting the angle defined between said first and second rigid clamp means as measured from the axis of said container to establish a desired effective size of said dispensing opening.

8. A method as in claim 7 including the further step of removing one of said rigid clamp members and positioning it at a different angular position, as measured from the axis of said container, in order to vary the effective opening of the container.

* * * * *